United States Patent [19]

Bockno

[11] 4,121,012

[45] Oct. 17, 1978

[54] CRIMPED, HIGH-STRENGTH RAYON YARN AND METHOD FOR ITS PREPARATION

[75] Inventor: Gregory C. Bockno, Media, Pa.

[73] Assignee: Avtex Fibers Inc., Valley Forge, Pa.

[21] Appl. No.: 655,811

[22] Filed: Feb. 6, 1976

Related U.S. Application Data

[63] Continuation-in-part of Ser. No. 376,430, Jul. 5, 1973, abandoned, which is a continuation of Ser. No. 84,202, Oct. 26, 1970, abandoned, which is a continuation-in-part of Ser. No. 709,375, Feb. 29, 1968, abandoned.

[51] Int. Cl.[2] ..... D01F 2/06; D01D 5/22

[52] U.S. Cl. ..... 428/369; 264/168; 264/198; 264/193; 264/194; 428/373; 428/374; 428/376; 428/397

[58] Field of Search ..... 264/168, 194, 188, 193; 428/369, 376, 374, 397, 373

[56] References Cited

U.S. PATENT DOCUMENTS

| | | | |
|---|---|---|---|
| 2,937,922 | 5/1960 | Mitchell et al. | 264/194 |
| 2,942,931 | 6/1960 | Mitchell et al. | 264/194 |
| 3,277,226 | 10/1966 | Bockno et al. | 264/194 |
| 3,296,000 | 1/1967 | Bockno et al. | 264/194 |
| 3,434,913 | 3/1969 | Bockno et al. | 264/194 |
| 3,494,996 | 2/1970 | Stevens et al. | 264/197 |

FOREIGN PATENT DOCUMENTS

| | | | |
|---|---|---|---|
| 38-1,016 | 2/1963 | Japan | 264/188 |
| 38-17,860 | 9/1963 | Japan | 264/188 |
| 38-18,570 | 9/1963 | Japan | 264/188 |
| 42-25,495 | 12/1967 | Japan | 264/188 |

*Primary Examiner*—Jay H. Woo
*Attorney, Agent, or Firm*—Arthur R. Eglington

[57] ABSTRACT

A crimped, high-strength regenerated cellulose yarn of filaments having a broken skin-core cross-sectional structure of which the skin comprises at least about 20 up to about 40% of the cross-sectional area, the peripheral skin surface is substantially smooth and the core section is "blown-out;" and a method of preparing the yarn from a specified viscose and spinning bath wherein the formed yarn is highly stretched and then crimped in the relaxed state in a plasticizing medium.

15 Claims, 4 Drawing Figures

CRIMPED, HIGH-STRENGTH RAYON YARN AND METHOD FOR ITS PREPARATION

CROSS REFERENCE TO RELATED APPLICATIONS

Figure 1:
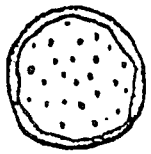

This application is a continuation-in-part of my copending application Ser. No. 376,430, filed July 5, 1973, (now abandoned) which is a continuation of my copending application Ser. No. 84,202, filed Oct. 26, 1970 (now abandoned) which is a continuation-in-part of application Ser. No. 709,375, filed Feb. 29, 1968 (now abandoned).

In U,S. Pat. No. 3,277,226, issued October 4, 1966, to G. C. Bockno and A. P. DaVinci, much improved regenerated cellulose yarn is disclosed and claimed having a combination of physical properties which have brought the yarn into great demand for textile uses.

It would be desirable to prepare this improved fiber as a crimped yarn or staple fiber, thereby, as is well-known increasing its coverage ability in textiles. Conventionally, crimped yarn is prepared by sluicing it in a plasticizing medium, such as hot water. However, the high tenacity, high wet modulus yarn, as described in the above patent, does not crimp when sluiced in a relaxed condition in a plasticizing medium, such as hot water.

It is a principal object of this invention to prepare a crimped, high-strength rayon yarn.

It is a further object of this invention to provide a method for the preparation of crimped, high-strength rayon yarn.

These and other objects are accomplished in accordance with this invention which comprises crimped yarn of regenerated cellulose filaments having a broken skin-core cross-sectional shape of which the skin comprises at least about 20 up to about 40%, preferably from about 25 to about 30%, of the cross-sectional area, the skin of said filaments being positioned at the inside of the bends and the exposed core being positioned at the outside of the bends of the crimp, the peripheral skin surface of said cross-sectional shape substantially smooth and the core section is "blown-out" or protrudes, said yarn having a wet tenacity of at least about 2.25 grams per denier, a conditioned tenacity of at least about 3.5 grams per denier, and a wet extensibility of from about 15 to about 22 percent.

The above-described yarn was crimped to a high degree by sluicing in a relaxed state in a plasticizing medium, such as hot water. The yarn denier per filament ranges from about 1 up to about 15 for this invention, while the crimp rating or number of crimps per inch generally ranges from about 10 to about 30, depending on the processing of the yarn and the yarn denier.

By utilizing the disclosed combination of processing variables which we have discovered, the crimped rayon filaments, staple fibers and yarn produced from these spinning solutions have been found to further possess high wet modulus, good elongation, and a high number of crimps per inch. The filaments and fibers of the invention have an initial wet modulus of 8 to 12 grams per denier, a conditioned elongation of 14 to 22 percent, and between 10 and 30 crimps per inch, preferably 20 to 30 c.p.i.

The crimped yarn is preferably produced in the form of staple fibers which are readily blended and processed for textile purposes.

This invention also includes a method of preparing the crimped, high-strength yarn of this invention which consists essentially of extruding a multiplicity of filaments of viscose prepared with from about 6 to about 9, preferably about 7.5, percent cellulose; from about 6 to about 9, preferably about 7.5, percent caustic soda; and from about 28 to about 39, preferably about 34, percent carbon disulfide; based on the weight of the cellulose, said viscose containing from about 1 to about 8% based on the weight of the cellulose of a regeneration retardant and having a spinning ball-fall viscosity of from about 40 to about 150, preferably from about 70 to about 80, and a common salt index of from about 6 to about 11, preferably about 7.5 to about 9.5, into a spinning bath containing; from about 4 to about 7, preferably about 5.0 to about 6.0 percent of sulfuric acid; from about 2 to about 5, preferably about 3 percent zinc sulfate; and from about 15 to about 24, preferably about 17 to about 20 percent sodium sulfate; spinning bath being maintained at a temperature ranging from about 30° to about 55° C., preferably from about 45° to about 50° C., withdrawing coagulated and incompletely regenerated filaments from said spinning bath and passing said filaments through an aqueous stretch bath maintained at a temperature ranging from about 75° to about 100° C., preferably from about 90° to about 95° C., and stretching said filaments in said stretch bath to about 90 to 140, preferably about 115 to about 130 percent.

The resulting yarn is crimped by exposing it, in the relaxed state, to a plasticizing medium. In a preferred embodiment, the wet yarn is cut into staple and dropped into a hot sluice bath where crimping takes place. The crimped staple is then wet processed and dried.

The yarn produced by the above method will vary in filament denier, mainly according to the size of the spinneret holes through which the viscose is extruded and the degree of stretch given the yarn. Other process variables will contribute in a minor way. In any event, the process is suitable for producing yarn having filament deniers ranging from about 1 to about 15, preferably 1.5 to 8. The number of filaments in the tow will vary only with the number of filaments simultaneously spun and brought together for processing.

The viscose is formed in a conventional manner and either during its preparation or at some stage prior to spinning, the regeneration retardant is added. These materials, their use and effect are well-known to those skilled in this art and include, for example, polyoxyalkylene glycol, such as polyoxyethylene glycols, polyoxypropylene glycols and block copolymers of propylene and ethylene oxides; various amines including monoamines, diamines and polyamines, such as diethylamine, dimethylamine, ethylene diamine and diethylenetriamine; reaction products of alkylene oxides with fatty acids, fatty alcohols, fatty amines, aromatic acids, aromatic alcohols, aromatic amines, partial esters of fatty acids and polyhydric alcohols, such as reaction products of ethylene oxide with lauryl alcohol, phenol, lauryl amine, glycerol monostearate, etc.; quaternary ammonium compounds, and the like. This type of material is more fully discussed in the prior art. For example, U.S. Pat. No. 2,879,170 lists many such compounds and terms them "coagulation modifiers." Other sources refer to these materials as "skin-forming viscose additives" or "viscose modifiers." In any event, these compounds and their effects are well-known.

The amount of modifier can vary from about 1% to about 8%, preferably 2% to 6%, based on the weight of the cellulose.

From the standpoint of availability, cost and performance, it is preferred to utilize a combination of modifiers, such as a monoamine and a polyoxyalkylene glycol or a polyoxyalkylene glycol ether of an aromatic alcohol or a polyhydric alcohol wherein the glycol or ether has a molecular weight of between about 600 and about 4000 to 6000; for example, dimethylamine and a polyoxyethylene glycol or a polyethylene glycol ether of phenol or sorbitol having a molecular weight within the stated range. In the use of the combination, the monoamine can be added in an amount of from about 1.0% to about 3.0%, and the glycol or ether in an amount of from about 2% to about 4%, both proportions being based upon the weight of the cellulose.

The viscose, for example, is aged (including the mixing and holding periods) from 10 to 30 hours and preferably has a total sulfur content of approximately 1.7% to 2.4% and a xanthate sulfur content of from about 1.1% to 1.6%. The sodium chloride salt test may be between 6 and 11 at the time of spinning and the ball-fall viscosity is between 40 and 150 seconds.

During spinning, the temperature of the bath should be maintained between 30° C. and 55° C. and the spinning speed may be between 15 and 50, preferably between 25 and 30, meters per minute.

From the spinning bath, the filaments, which are coagulated and incompletely regenerated, are passed directly through a second bath, or stretch bath, maintained at a temperature between 75° C. and 100° C. and the filaments are stretched from about 90% to about 140% during their travel through this bath. The stretch bath may be a hot water bath or may contain from 1% to 5% sulfuric acid, about 1% to 4% zinc sulfate and from about 4% to 7% sodium sulfate. At this point, the regenerated, crimpable rayon may be wet processed, dried under tension and wound or, as is preferred, cut into staple, sluiced in hot water to obtain crimp, and then wet processed and dried.

Filaments and fibers produced from the described viscose and spun under the foregoing conditions possess the properties and characteristics as described herein.

Figure 4:
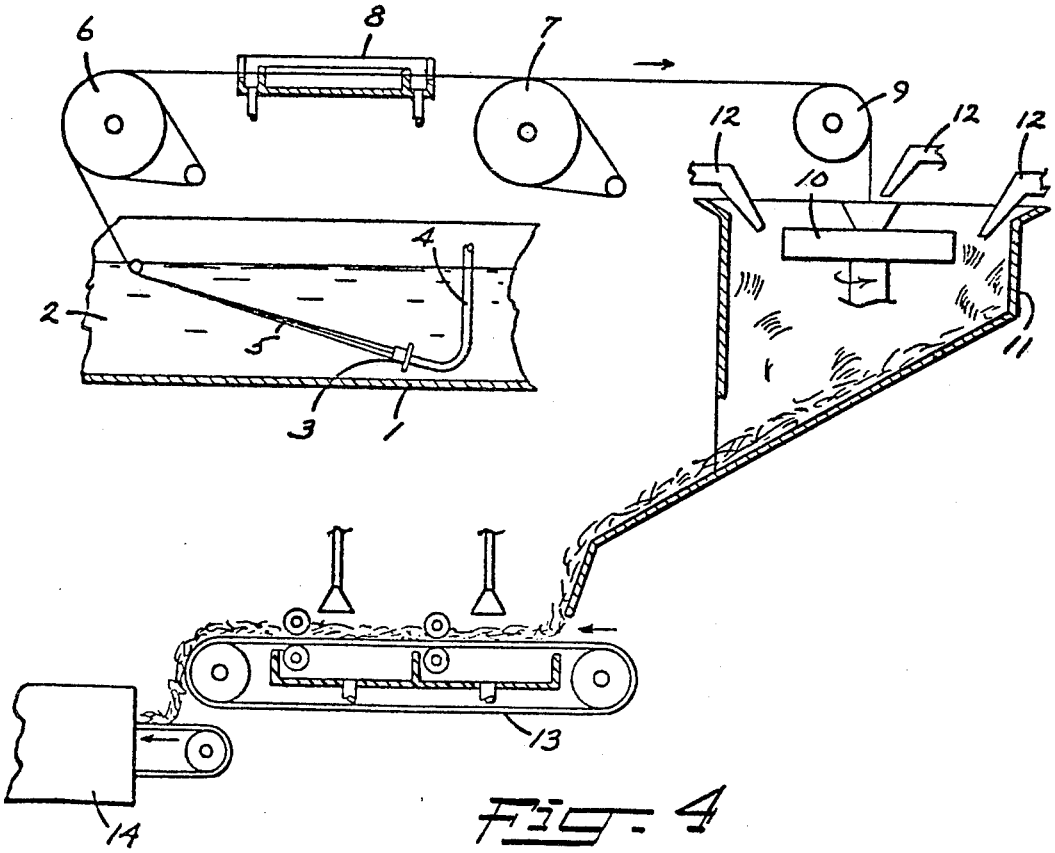

The fibers and filaments may be produced and the method of forming them may be practiced with conventional equipment, such as that shown diagrammatically in FIG. 4 of the accompanying drawing. A trough or tank 1 is provided as a container for the spinning bath 2, which is generally recirculated in practice. Means for circulating the bath are not shown, such means being conventional in the art. A spinneret 3, mounted at the end of rounder 4, is positioned in the tank 2 being submerged in the spinning bath. The viscose is delivered from a suitable source (not shown) to the rounder, and is extruded through the spinneret to form the filaments 5, which upon leaving the spinning bath, pass to positively driven godet 6 rotating at a speed to provide a minimum of jet stretch, and then on to a second positively driven godet 7. The godet 7 is driven at a speed greater than godet 6 and the relative speeds of the godets are selected so as to provide for the required stretching of the filaments between the two godets. Interposed between the godets, there is mounted a trough 8 through which a second or stretching bath is circulated. The stretching bath is maintained at a high temperature which plasticizes, to some extent, the filaments and permits a higher degree of stretching. The stretching bath also effects a further regeneration of the cellulose in the coagulated and partially regenerated filaments formed in the spinning bath 2. From the godet 7, the filaments may be passed through suitable aftertreatment zones under tension and then collected on a cone or the like; however, in the preferred embodiment, the filaments are passed from godet 7 around godet 9 to a suitable cutting device 10 wherein the filaments are cut to form staple fibers and dropped into a sluice box 11 into which hot water is fed through nozzles 12. Conventionally, the staple fibers are then deposited as a mat on belt 13 and the mat of fibers then subjected to the required aftertreatments and drying in dryer 14.

To illustrate more specifically the method of forming filaments and fibers of the present invention, the following example is included.

EXAMPLE I

Viscose was prepared by treatment of pulp sheets (high 98% alpha-cellulose, viscose grade pulp) with caustic soda, shredding the resulting alkali cellulose, xanthating the alkali cellulose and dissolving it in a caustic soda solution. The viscose so prepared contained 7.5% cellulose, 7.5% caustic soda and 34% carbon disulfide, based on the weight of the cellulose. Dimethylamine (1.75%) and 3.5% of polyoxyethylene glycol ether of phenol containing an average of 15 ethylene oxide units per mole of phenol, was incorporated in the viscose during the mixing operation. The viscose was then aged in the conventional manner at 18° C. for 14 hours.

The viscose at the time of spinning had a sodium chloride salt test of about 8.5, and a ball-fall viscosity of 70 to 80 seconds. Ball-fall viscosity is obtained by measuring the time in seconds required for a solid steel ball of $\frac{1}{8}$ inch diameter to fall 8 inches in a column of viscose of $\frac{3}{4}$ inch diameter at 18° C.

The dimethylamine and phenol ether may be added at any stage in the preparation of the viscose to serve as a regeneration retardant.

The viscose was spun to form a 1.5 denier, 12,000 filament yarn by extrusion of the viscose through orifices about 0.0025 inch in diameter into a spinning bath containing 5% sulfuric acid, 17% sodium sulfate and 3% zinc sulfate, the spinning bath being maintained at a temperature of about 48° C. The filaments were withdrawn from the bath, passed over a first godet, through a hot second bath, over a second godet, cut into staple, sluiced, aftertreated, and dried. The second bath was formed by diluting some of the spinning bath and contained about 2.5% sulfuric acid, about 1.5% zinc sulfate and about 8% sodium sulfate, and was maintained at a temperature of about 95° C. During passage of the filaments through the hot bath, they were stretched approximately 115%. The spinning speed was about 25 meters per minute. The wet yarn was cut into staple length fibers and dropped into a water sluice bath maintained at about 95° C. The staple fibers formed from 25 to 30 crimps per inch in the sluice bath. The crimped staple was then wet processed and dried.

The crimped fiber had a conditioned tenacity of about 4 grams per denier, a wet tenacity of about 2.7 grams per denier, a conditioned extensibility of about 14 percent, a wet extensibility of about 19 percent, an initial wet modulus of about 10.0, and was a substantially non-fibrillatable fibrous product. In cross-section, a representative filament had a smooth, broken skin which comprised about 25% of the cross-sectional area and encompassed about 65% of the periphery of the cross-section. The core was "broken-out" of the filament cross-section to provide an unbalanced shape.

EXAMPLE II

Viscose was prepared by treatment of pulp sheets (98% alpha-cellulose, viscose grade pulp) as described in Example I. The viscose so prepared contained 7.55% cellulose, 7.5% caustic soda and 31% carbon disulfide, based on the weight of the cellulose. Dimethylamine (1.05%) and 2% of polyoxyethylene glycol ether of phenol, containing an average of 15 ethylene oxide units per mole of phenol, was incorporated in the viscose during the mixing operation. The viscose was then aged in the conventional manner as in Example I.

The viscose at the time of spinning had a sodium chloride salt test of about 8.7, and a ball-fall viscosity of 80 to 90 seconds.

The viscose was spun to form a 1.49 to 1.67 denier, 28,500 filament yarn by extrusion of the viscose through orifices of about 0.002 inch in diameter into a spinning bath containing 6.0 to 6.5 percent sulfuric acid, 17 percent sodium sulfate and 2.8 percent zinc sulfate, the spinning bath being maintained at a temperature of about 48° C.

The filaments were withdrawn from the bath, passed over a first godet, through a hot second bath, over a second godet, cut into staple, sluiced, aftertreated, and dried.

A second bath was formed by diluting some of the spinning bath and contained about 2.5 percent sulfuric acid, about 1.5 percent zinc sulfate and about 8 percent sodium sulfate, and was maintained at a temperature of about 95° C. During passage of the filaments through the hot bath, they were stretched approximately 105 percent. The spinning speed was about 29 meters per minute.

The wet yarn was cut into staple length fibers and dropped into a water sluice bath maintained at about 95° C. The staple fibers formed from 21 to 25 crimps per inch in the sluice bath. The crimped staple was then wet processed and dried.

The crimped fiber had a conditioned tenacity ranging from 3.45 to 3.60 grams per denier, a conditioned elongation of from 20.2 to 21.0 percent, and was a substantially non-fibrillatable fibrous product.

In cross-section, a representative filament had a smooth broken skin which comprised from 20 to 25 percent of the cross-sectional area and encompassed about 75 percent of the periphery of the cross-section. The core was "broken-out" of the filament cross-section to provide an unbalanced shape.

Similarly, fibers having filaments ranging in denier up to about 15 and having like physical characteristics, may be spun and processed with crimp ratings in most instances dropping to about 10 with the high denier filament yarns.

It will be noted that the above-described process steps, with certain critical exceptions, conform to those of the above-mentioned U.S. Pat. No. 3,277,226. The process of that patent produces a yarn wherein the individual filaments have a cross-sectional structure as representatively shown in FIG. 1 of the drawing. This type of structure may be defined as a smooth, unbroken skin-core cross-section wherein the skin comprises from about 20 to about 40% of the total cross-section. Yarns of these filaments, as described in the aforementioned patent, have extremely desirable physical characteristics, but they do not crimp when placed relaxed in a plasticizing medium. To obtain a crimpable yarn approaching the high physical and structural qualities of this prior high-stretch yarn, it was found that the spinning conditions must be modified to a small, but critical degree. Outside of these critical limitations, for the viscose composition employed, one either would not obtain the desired crimp rating, or, in the other extreme, the loss of physical properties would be too great.

The critical spinning conditions for this invention were found to be, in combination:

(1) A specified higher range for the sodium sulfate concentration in the spinning bath;
(2) A generally higher temperature maintenance for the spinning bath; and
(3) A generally lower range for the sulfuric acid concentration in the spin bath.

It should be observed that all of the spinning conditions, including the viscose specifications, are considered critical for the preparation of the crimpable yarn of this invention. Should viscose of a different specification than described be employed, the yarn quality would be changed. However, with the viscose employed herein, the above critical spinning conditions produce a yarn having individual filament cross-sectional shapes, as representatively shown in FIG. 2 of the drawing. It is seen that the cross-section shown in FIG. 2 differs from that of FIG. 1 in the presence of a broken skin portion which has shrunk back somewhat to permit the "blowing-out" or protrusion of some of the core material. This is in contrast to fibers of uneven cross-section which are substantially circular, that is, have a conjugate spinning type of cross structure without a "blown-out" or protruding core section such as shown in Japanese Patent Publication No. 41-17699 of Aug. 10, 1966. Ideally, the broken skin remains smooth and covers at least 50 and up to about 75% of the periphery of the cross-sectional shaped. This permits retention of much of the high strength characteristics and quality of the filament type shown in FIG. 1. Should different spinning conditions be employed, the yarn properties and filament cross-section would be modified to the point of defeating the objects of this invention. For example, the filament skin could remain unbroken with a resulting non-crimpable yarn; the broken filament skin could retract to a degree causing considerable loss of yarn strength; or the filament skin surface could become crenulated, such as seen in FIG. 3, a representative cross-section of a filament of conventional crimped rayon yarn, causing loss of yarn strength and increasing soil retention properties.

Figure 2:
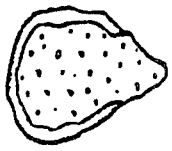
Figure 3:
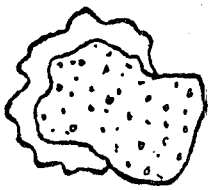

As will be evident from FIG. 2 the skin there is like that of FIG. 1 (and unlike that of FIG. 3) in that it is substantially smooth; it is like that of FIGS. 1 and 3 in that it is substantially uniform in thickness throughout, with its thickness at any one point being much less than the thickness of the core.

It is seen then, that the spinning conditions for this invention are critical in order to obtain a yarn which will crimp satisfactorily without excessive loss of high-strength characteristics and quality.

The wet moduli of the yarns of this invention, as defined in U.S. Pat. No. 3,277,266, can be brought up to as high as about 12, depending on the degree of stretch and bath temperature within the given ranges. The higher wet moduli are obtained by higher stretch and lower bath temperatures.

For the purposes of this invention, the term "skin" is employed to designate that portion of the regenerated cellulose filaments which is permanently stained or dyed by the following procedure: A microtome section of one or more filaments mounted in a wax block is taken and mounted on a glass slide with Meyer's albumin fixative. After dewaxing in xylene, the section is placed in successive baths of 60 percent and 30 percent alcohol for a few minutes each, and it is then stained in a 2 percent aqueous solution of Victoria Blue BS conc. (General Dyestuffs Corp.) for 1 to 2 hours. At this point, the entire section is blue. By rinsing the section first in distilled water and then in one or more baths composed of 10 percent water and 90 percent dioxane for a period varying from 5 to 30 minutes, depending on the particular filament, the dye is entirely removed from the "core", leaving it restricted to the "skin" area.

The crimped rayon yarns and fibers are used alone or in blends with natural or synthetic fibers to produce textiles with improved coverage. The crimped staple of this invention was made into both woven and knitted fabrics which were observed to provide a significant improvement in cover when compared with fabrics prepared from the non-crimping fiber of U.S. Pat. No. 3,277,226. The crimped staple also imparted more bulk to these fabrics.

Various changes and modifications may be made practicing this invention without departing from the spirit and scope thereof, and therefore, the invention is not to be limited, except as defined in the appended claims.

What is claimed is:

1. A method for preparing crimped high-strength rayon which consists essentially of extruding a multiplicity of filaments of viscose prepared with from about 6 to about 9 percent cellulose, from about 6 to about 9 percent caustic soda, and from about 28 to about 39 percent carbon disulfide, based on the weight of the cellulose, said viscose containing from about 1 to about 8 percent based on the weight of the cellulose of a regeneration retardant, and having a spinning ball-fall viscosity of from about 40 to about 150 and a common salt index of from about 6 to about 11, into a spinning bath containing from about 4 to about 7 percent sulfuric acid, from about 2 to about 5 percent zinc sulfate and from about 15 to about 24 percent sodium sulfate, said spinning bath being maintained at a temperature ranging from about 30° to about 55° C., withdrawing coagulated and incompletely regenerated filaments from said spinning bath and passing said filaments through an aqueous stretch bath maintained at a temperature ranging from about 75 to about 100° C., stretching said filaments in said stretch bath from about 90 to about 140 percent and then sluicing the filaments in a relaxed state in a plasticizing medium.

2. The method of claim 1 wherein the crimped high-strength rayon filaments produced range in denier from about 1.5 to about 8.

3. The method of claim 2 wherein the stretched filaments are cut into staple fibers and the staple fibers sluiced in an aqueous bath maintained at a temperature of from about 75° to about 100° C.

4. The method of claim 1 wherein the viscose is prepared with about 7.5 percent cellulose, about 7.5 percent caustic soda and about 34 percent carbon disulfide, said viscose containing as a regeneration retardant, about 1.75 percent dimethylamine and about 3.5 percent of a polyoxyethylene glycol ether of phenol, said viscose having a spinning ball-fall viscosity of from about 70 to about 80 and a common salt index of from about 7.5 to about 9.5.

5. The method of claim 11 wherein the spinning bath contains about 5 to about 6.5 percent sulfuric acid, about 3 percent zinc sulfate, about 17 to about 20 percent sodium sulfate and is maintained at about 48° C., and said aqueous stretch bath contains about 2.5 percent sulfuric acid.

6. The method of claim 1 wherein the crimped high-strength rayon filaments produced range in denier from about 1.5 to about 8 and the stretched filaments are cut into staple fibers and sluiced in a water bath maintained at about 75° to 100° C.

7. The products of the method of claim 1.

8. A crimped yarn comprising regenerated cellulose filaments having a broken skin-core-sectional structure of which the skin comprises at least about 20 percent up to about 40 percent of the cross-sectional area, the skin of said filaments being positioned at the inside of the bends and the core being positioned at the outside of the bends of the crimp, the peripheral skin surface of said cross-sectional structure being substantially smooth and the core section protruding from said structure, said yarn having a wet tenacity of at least about 2.25 grams per denier, a conditioned tenacity of at least about 3.5 grams per denier, and a wet extensibility ranging from about 15 to about 22 percent, said filaments having been formed by the method of claim 9.

9. The crimped yarn of claim 1 wherein the individual filament denier ranges from about 1.5 up to about 8.

10. The crimped yarn of claim 1 in the form of staple fibers.

11. The crimped yarn of claim 1 wherein the individual filaments have cross-sectional structure in which the skin portion is of substantially uniform thickness.

12. The crimped yarn of claim 1 having an initial wet modulus of about 10 to 12.

13. The crimped yarn of claim 1 having between 10 and 30 crimps per inch.

14. The crimped yarn of claim 1 having a conditioned elongation of 14 to 22 percent.

15. A fabric comprising the yarn of claim 1.

* * * * *

UNITED STATES PATENT AND TRADEMARK OFFICE

CERTIFICATE OF CORRECTION

PATENT NO. : 4,121,012

DATED : October 17, 1978

INVENTOR(S) : Gregory C. Bockno

It is certified that error appears in the above-identified patent and that said Letters Patent are hereby corrected as shown below:

Column 1, line 60, italicize the word "high";

Column 8, line 17, the number "11" should be the number "3";
Column 8, line 42, the number "9" should be the number "1";
Column 8, line 43, the number "1" should be the number "8";
Column 8, line 45, the number "1" should be the number "8";
Column 8, line 47, the number "1" should be the number "8";
Column 8, line 50, the number "1" should be the number "8";
Column 8, line 52, the number "1" should be the number "8";
Column 8, line 54, the number "1" should be the number "8";
Column 8, line 56, the number "1" should be the number "8".

Signed and Sealed this

*Tenth* Day of *April 1979*

[SEAL]

*Attest:*

RUTH C. MASON
*Attesting Officer*

DONALD W. BANNER
*Commissioner of Patents and Trademarks*